US006659408B2

(12) United States Patent
Au et al.

(10) Patent No.: US 6,659,408 B2
(45) Date of Patent: Dec. 9, 2003

(54) FREE SIZE AUTOMATIC WATCH DISPLAY HOLDER

(76) Inventors: Kinsen Ka Fai Au, Blk. A, 9/F, Goodview Ind. Bldg., 11 Kin Fat St., Tuen Mun, N.T. (HK); Kin Keung Chiu, Blk. A, 9/F, Goodview Ind. Bldg., 11 Kin Fat St., Tuen Mun, N.T. (HK)

( * ) Notice: Subject to any disclaimer, the term of this patent is extended or adjusted under 35 U.S.C. 154(b) by 0 days.

(21) Appl. No.: 10/165,756

(22) Filed: Jun. 7, 2002

(65) Prior Publication Data

US 2003/0001052 A1 Jan. 2, 2003

Related U.S. Application Data

(63) Continuation-in-part of application No. 09/738,510, filed on Dec. 18, 2000, now abandoned.

(51) Int. Cl.[7] ..... A47F 7/00
(52) U.S. Cl. ..... 248/114; 206/6.1; 206/3.01
(58) Field of Search ..... 248/114–116, 295.11; 206/301, 6.1, 5, 776, 566; 211/85.2, 163; 368/316; 40/642.01

(56) References Cited

U.S. PATENT DOCUMENTS 2,790,301 A * 4/1957 Dindtman ..... 368/277
4,010,925 A * 3/1977 Garchinsky ..... 248/295.11
4,261,461 A * 4/1981 Kizlauskas ..... 206/765
5,168,985 A * 12/1992 Shih ..... 206/6.1
5,425,444 A * 6/1995 Chapman ..... 206/6.1
5,833,052 A * 11/1998 Diamond ..... 206/6.1
6,241,105 B1 * 6/2001 Pomper ..... 211/85.2
6,273,246 B1 * 8/2001 Marciano ..... 206/301
6,341,751 B1 * 1/2002 Herzog ..... 248/114

* cited by examiner

*Primary Examiner*—Anita King
*Assistant Examiner*—Tan Le
(74) *Attorney, Agent, or Firm*—Raymond Y. Chan; David and Raymond Patent Group

(57) ABSTRACT

A free size automatic watch display holder includes an upper holder providing an arc shaped upper supporting surface, a lower holder providing an arc shaped lower supporting surface, and an extendable supporting frame mounted between the upper and lower holders. The supporting frame includes an upper support member transversely extended from an inner surface of the upper holder, a lower support member transversely extended from an inner surface of the lower holder, and a movable operating frame including a base, having a slider slot, upwardly extended from the lower support member and a slider arm which is downwardly extended from the upper support member and arranged to slidably insert into the slider slot such that by frictionally sliding the slider arm along the slider slot so as to selectively adjust a distance between the upper and lower holders.

17 Claims, 4 Drawing Sheets

FREE SIZE AUTOMATIC WATCH DISPLAY HOLDER

CROSS REFERENCE OF RELATED APPLICATION

This is a Continuation-In-Part application of a non-provisional application, application No. 09/738,510, filed Dec. 18, 2000, now abandoned.

BACKGROUND OF THE PRESENT INVENTION

1. Field of Invention

The present invention relates to a watch display holder, and more particularly to a free size automatic watch display holder which can selectively adjust its size to hold various sizes and different types of watchband.

2. Description of Related Arts

The market for watches is highly competitive and saturated. For the well-known brand name watch, the name sells the watch. However, for inexpensive watches, the marketing, the advertising, and the display are sometimes more integral to the sale of watch than the actual watch itself.

Watches come in all sizes and varieties, such as men's watches, lady's watches, and child's watches. Moreover, watchbands may be thin or thick, wide or narrow. The length of the watchbands varies with the size of the wrist of the wearer to be surrounded. The watchband may be chain-type and made of metal, or belt-type and made of leather, simulated leather or other cloth type material.

Presently, since watches come in various sizes and shapes, watch holder must be shaped and sized to fittedly support the watch. In order to display the watches or keep them properly, the watches are often fitted in a clasped state around a watchband-supporting frame. Generally speaking, the watchband-supporting frame has a "C" or "O" shape such that the watch is arranged to clasp around the watchband-supporting frame to keep the watch in position.

These simple "C" or "O" shaped watchband-supporting frames come in different sizes to fit the variety of watches available in the marketplace. Practically, a man's watch has a bigger watchband than a woman's watch or a child's watch. Therefore, the watchband-supporting frame for man's watch or a child's watch. Therefore, the watchband-supporting frame for man's watch must be shaped and sized accordingly so that the man's watch can fit snugly around the watchband-supporting frame. Similarly, the watchband-supporting frame for the child's watch has a smaller size to accommodate the smaller watchband thereof.

Subsequently, great cost must be involved in the purchase of various kinds of watch holders having different sizes because the watch manufacturer cannot find a standardized watch holder or watchband-supporting frame to fit the great variety of watches.

SUMMARY OF THE PRESENT INVENTION

A main object of the present invention is to provide a free size automatic watch display holder for displaying and storing a watch, allowing one universal watch holder to be used for variety of watches, vary in size and/or composition of the watchband.

Another object of the present invention is to provide a free size automatic watch display holder which does not employ complicate structure and has minimized components, so as to minimize the manufacturing cost and assembly labor.

Another object of the present invention is to provide a free size automatic watch display holder, wherein an upper supporting surface and a lower supporting surface of the display holder are firmly biased against an inner side of the watch by means of resilient arrangement, so as to securely hold the watch in position.

Another object of the present invention is to provide a free size automatic watch display holder, wherein the mounting operating of the present invention to the watch is simple and easy that one individual is able to mount the watch around the display holder in seconds.

Another object of the present invention is to provide a free size automatic watch display holder, wherein no expensive or complicated mechanical structure is required to employ in the present invention in order to achieve the above mentioned objects. Therefore, the present invention successfully provides an economic and efficient solution for providing a reinforced supporting configuration to supportively hold the watch.

Accordingly, in order to accomplish the above objects, the present invention provides a free size automatic watch display holder, comprising:

- an upper holder providing an arc shaped upper supporting surface;
- a lower holder providing an arc shaped lower supporting surface; and
- an extendable supporting frame comprising:
  - an upper support member transversely extended from an inner surface of the upper holder;
  - a lower support member transversely extended from an inner surface of the lower holder; and
  - a movable operating frame comprising a base, having a slider slot, upwardly extended from the lower support member and a slider arm which is downwardly extended from the upper support member and arranged to slidably insert into the slider slot such that by frictionally sliding the slider arm along the slider slot so as to selectively adjust a distance between the upper and lower holders.

DETAILED DESCRIPTION OF THE PREFERRED EMBODIMENT

Figure 1:
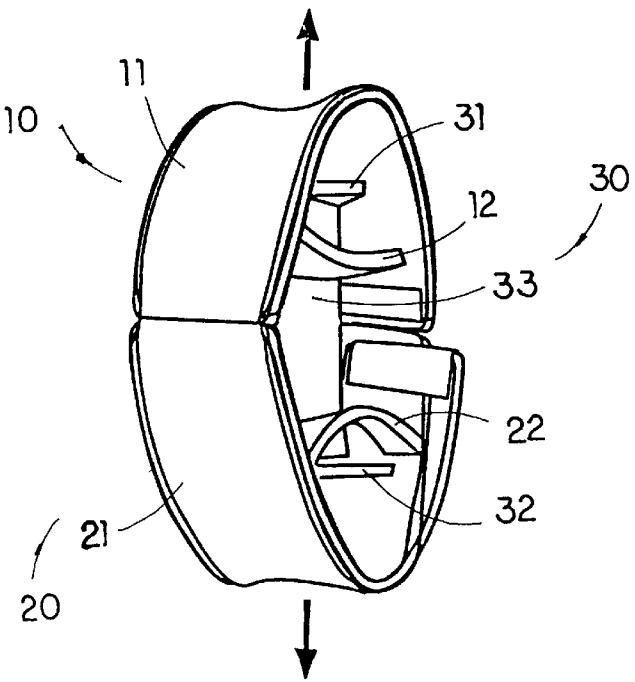
FIG. 1 is a perspective view of a free size automatic watch display holder according to a first preferred embodiment of the present invention.
Figure 3:
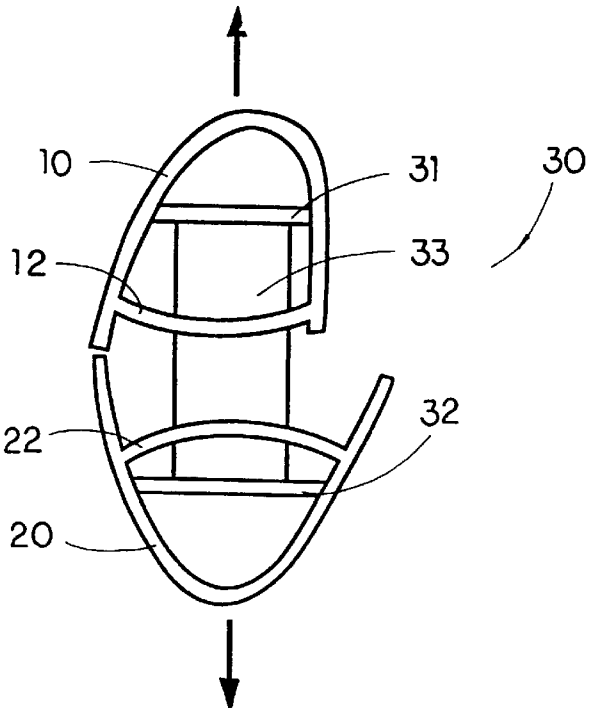
FIG. 3 is a side view of the free size automatic watch display holder according to the above first preferred embodiment of the present invention.

Referring to FIGS. 1 and 3 of the drawings, a free size automatic watch display holder according to a first preferred embodiment of the present invention is illustrated, wherein the free size automatic watch display holder is adapted for holding watches of various sizes and different types of watchband.

Figure 5:
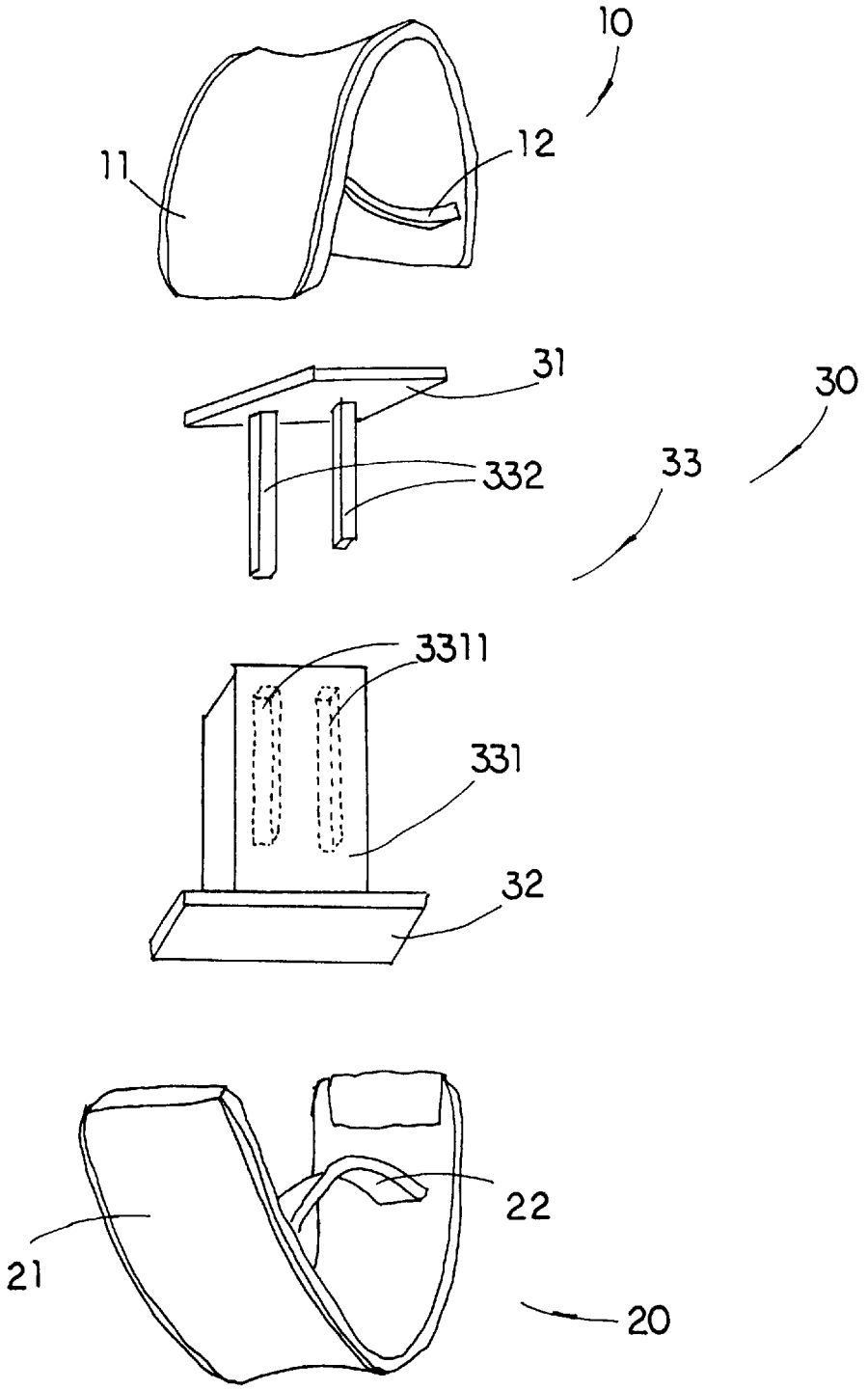
FIG. 5 is an exploded perspective view of the free size automatic watch display holder according to the above first preferred embodiment of the present invention.

As shown in FIG. 5, the free size automatic watch display holder comprises an upper holder 10 providing an arc shaped upper supporting surface 11, a lower holder 20 providing an arc shaped lower supporting surface 21, and an extendable supporting frame 30 supported between the upper holder 10 and the lower holder 20.

The extendable supporting frame 30 comprises an upper support member 31 transversely extended from an inner surface of the upper holder 10, a lower support member 32 transversely extended from an inner surface of the lower holder 20, and a movable operating frame 33 comprising a base 331, having a slider slot 3311, upwardly extended from the lower support member 32 and a slider arm 332 which is downwardly extended from the upper support member 31 and arranged to slidably insert into the slider slot 3311 such that by frictionally sliding the slider arm 332 along the slider slot 3311 so as to selectively adjust a distance between the upper and lower holders 10, 20.

The upper supporting surface 11 of the upper holder 10 is provided at an outer side thereof and the lower supporting surface 21 of the lower upper holder 20 is provided at an outer side thereof. The upper holder 10 and the lower holder 20 are adapted to move towards each other in a closed position and to move away from each other in an opened position. In other words, the watch display holder is designed to hold the watch in circular position.

The upper holder 10 and the lower holder 20 are made of semi-rigid material wherein each of said upper and lower holders 10, 20 is capable of selectively adjusting a width between two ends of each of the upper and lower holders 10, 20. In other words, a curvature of each of the upper and lower holders 10, 20 can be adjusted to fittedly bias against an inner side of the watch when the watch is mounted around the watch display holder of the present invention. Moreover, each of the upper and lower holders 10, 20 should be formed a flat upper and lower supporting surfaces 11, 12 respectively so as to enhance the surfaces of the upper and lower holders 10, 20 in contact with the inner side of the watch. Preferably, a soft fabric is provided on each of the -upper and lower supporting surfaces 11, 12 of the upper and lower holders 10, 20 to enhance the aesthetic appearance of the watch display holder and well protect the watch held thereon so as to prevent an unwanted scratch by the watch display holder.

Thus, each of the upper and lower holders 10, 20 has a predetermined width that must be at least as wide as a width of the watchband of the watch in order to allow adequate support for the watchband when the watch is mounted around the watch display holder.

The supporting frame 30 is rigidly supported between the upper holder 10 and the lower holder 20 wherein the supporting frame 30 is adapted to vertically extend in a slidably movable manner, so as to adjustably increase the distance between the upper holder 10 and the lower holder 20. Preferably, the supporting frame 30 is made of durable material such as plastic which is in low cost and easy to manufacture in order to support the watch display holder rigidly.

Figure 2:
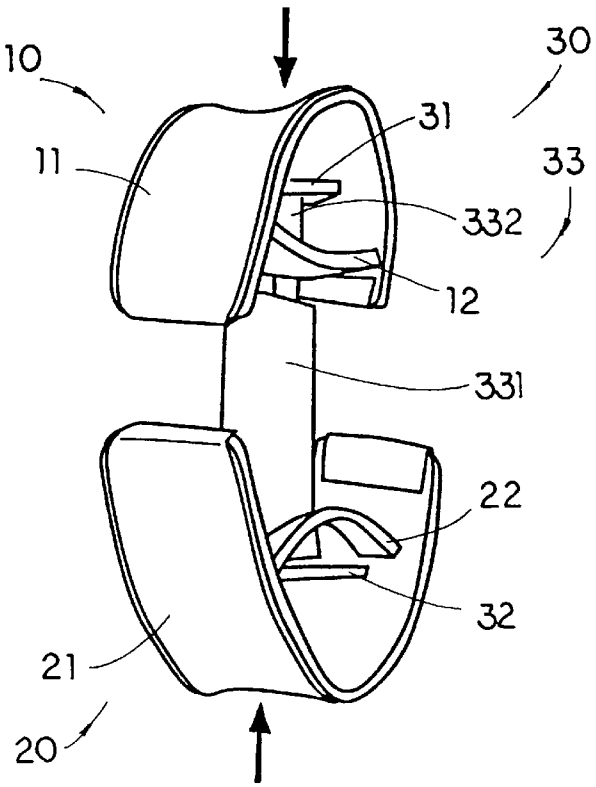
FIG. 2 is a perspective view of the free size automatic watch display holder in an opened position according to the above first preferred embodiment of the present invention.
Figure 4:
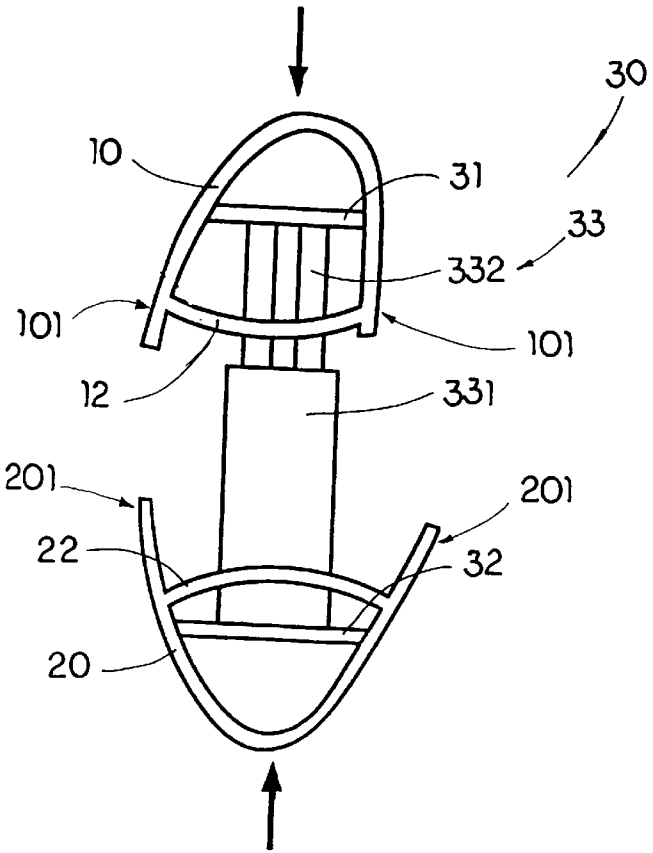
FIG. 4 is a side view of the free size automatic watch display holder according to the above first preferred embodiment of the present invention.

According to the preferred embodiment, the base 331 of the movable operating frame 33 is upwardly and perpendicularly extended from the lower supporting member 32. The base 331 has a pair of parallel slider slots 3311 vertically and downwardly extended from a top of the base 331. Accordingly, there are two slider arms 332 downwardly extended from the upper supporting member 31 wherein the two slider arms 332 are fittedly received in the slider slots 3311 respectively in a slidably movable manner such that the slider arms 332 are adapted to frictionally slide along the slider slots 3311 respectively. A top end of each slider arm 332 is perpendicularly affixed to the upper supporting member 31 such that when the upper holder 10 is pulled upwardly, the slider arms 332 are arranged to slide upwardly along the slider slots 3311, so as to adjust the distance between the upper holder 10 and the lower holder 20, as shown in FIGS. 2 and 4.

Each of the slider arms 332 has a predetermined length adapted to slide along the respective slider slot 3311 between the opened position and the closed position, wherein in the opened position, the upper holder 10 is moved to space apart from the lower holder 20, and in the closed position, the upper holder 10 is moved towards to the lower holder 20 to form a loop structure while two ends of the upper holder 10 are biased against two ends of the lower holder 20 respectively.

As shown in FIG. 5, each of the slider arms 332, having a rectangular cross section, is fittedly slid along the respective slider slot 3311 having the corresponding shaped. Since there are two slider arms 332 slidably inserted into the two slider slots 3211 respectively, the slider arms 332' are adapted to maintain the upper holder 10 in position, so as to prevent any twisting movement of the upper holder 10 with respect to the lower holder 20.

Moreover, it is obvious that only one slider arm 332 is extended from the upper supporting frame 31 to slidably insert into the slider slot 3311 of the base 331. However, the slider arm 332 must be constructed to have a non-circular cross sectional structure to slidably insert into the slider slot 3311 having the corresponding size and shape, so as to prevent the twisting movement of the upper holder 10 with respect to the lower holder 20.

Due to a mutual frictional force exerted on contact surfaces between the slider arms 332 and inner surfaces of the slider slots 3311 of the base 331, the upper holder 10 is frictionally held in position. So, the user is able to simply adjust a height of the watch display holder, which is the distance between the upper and lower holders 10, 20, in order to fit the various sizes of the watch.

In order to maintain the arc shape of the upper holder 10 and the lower holder 20, the watch display holder further comprises an upper holding frame 12 affixed to the upper holder 10 and a lower holding frame 22 affixed to the lower holder 20. Accordingly, the upper holding frame 12 is affixed to the inner surface of the upper holder 10 at two end portions thereof to retain the upper holder 10 in an arc shaped structure and the lower holding frame 22 is affixed to the inner surface of the lower holder 20 at two end portions thereof to retain the lower holder 20 in an arc shaped structure.

As shown in FIG. 4, the upper holding frame 12 has two ends integrally extended from two end portions 101 of the upper holder 10 respectively and the lower holding frame 22 has two ends integrally extended from two end portions 201 of the lower holding frame 22 respectively such that the upper holding frame 12 and the lower holding frame 22 are capable of keeping the upper holder 10 and the lower holder 20 in the arc shape manner respectively.

The upper and lower holding frames 12, 22 are made of semi-rigid material that adapted to be bent in a curved shape.

It is worth mentioning that when the curvature of each of the upper and lower holders 10, 20 is adjusted to fittedly support the watch, each of the upper and lower holding frames 12, 22 is capable of bending to adjust the width between the two ends thereof so as to retain the shape of each of the upper and lower holders 10, 20.

Moreover, the upper support member 31 is mounted to the upper holder 10 at a position above the upper holding frame 12 and the lower support member 32 is mounted to the lower holder 20 at a position below the lower holding frame 22 such that the operation of the movable operating frame 30 will not be interrupted the width adjustment of each of the upper and lower holders 10, 20.

Practically, all sizes of watch can be fittedly mounted around the watch display holder of the present invention in the circular manner for displaying and storing purpose. For a smaller size of watch, such as woman's size or child's size, the slider arms 332 are slidably moved towards bottom ends of the slider slots 3311 respectively so as to reduce the distance between the upper holder 10 and the lower holder 20 since the circumference of the watch is relatively small. For a larger size of watch, such as a man's size which has a larger circumference, the slider arms 332 are adapted to slidably move away from the bottom ends of the slider slots 3311 respectively so as to increase the distance between the upper holder 10 and the lower holder 20.

In order to use the watch display holder, the user simply minimizes the height of the watch display holder by pulling the upper holder 10 towards the lower upper 20, and places the watch display holder to the inner circumference of the watch. Then, the user may pull the upper holder 10 away from the lower holder 20 to lengthen the height of the watch display holder such that the watch will be fittedly mounted around the watch display holder in the circular manner. It is worth mentioning that by adjusting the width of the two ends of each of the upper and lower holders 10, 20, the upper supporting surface 11 of the upper holder 10 and the lower supporting surface 21 of the lower holder 20 are fittedly in contact with the inner circumference of the watch, so as to substantially support the watch, especially for displaying the watch.

Moreover, the user is able to take out the watch display holder from the watch by simply pulling the upper holder 10 towards the lower holder 20 to reduce the height of the watch display holder until the inner circumference of the watch is departed from the upper and lower supporting surfaces 11, 21 of the upper and lower holders 10, 20.

Figure 6:
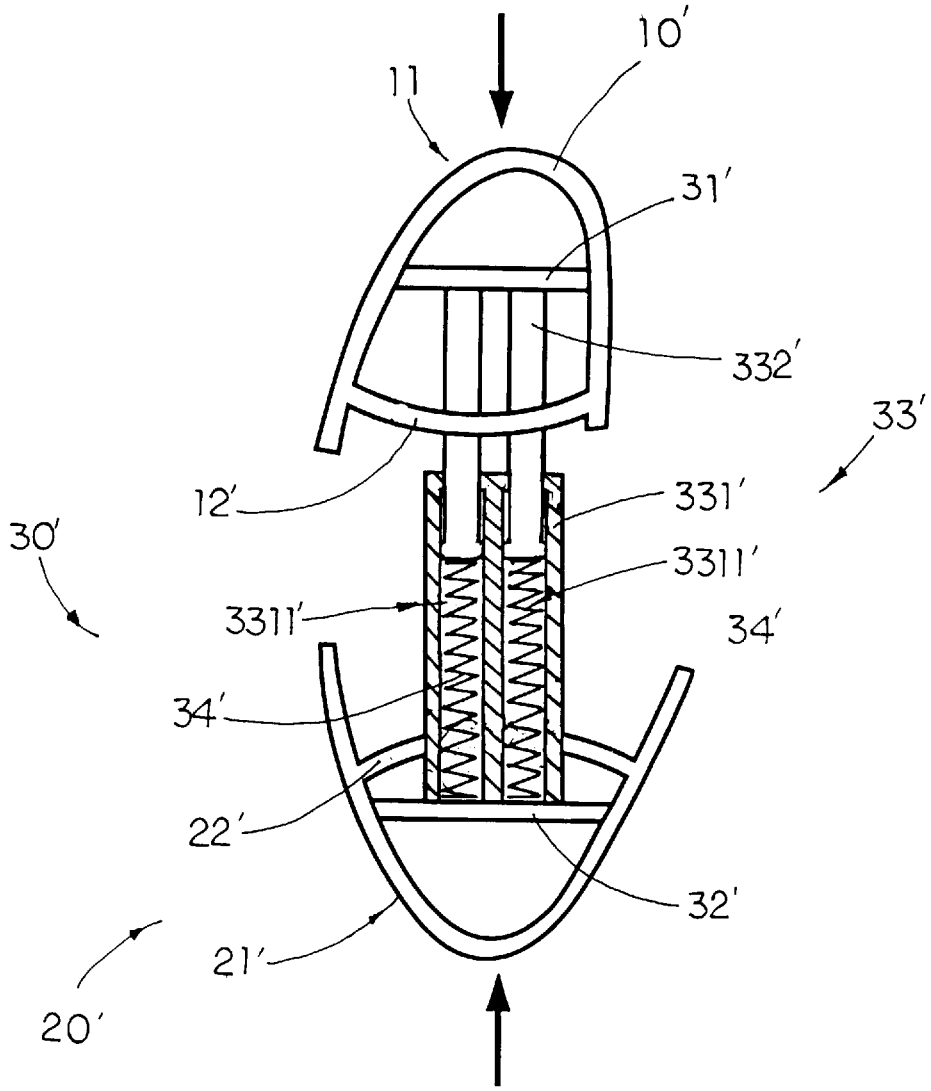
FIG. 6 is a sectional view of a free size automatic watch display holder according to a second preferred embodiment of the present invention.

As shown in FIG. 6, a second embodiment of the watch display holder illustrates an alternative mode of the first preferred embodiment, wherein the watch display holder has the same structural design of the first embodiment, except the extendable supporting frame 30' further provide a resilient ability to retain the distance of the upper and lower holders 10', 20'.

According to the second embodiment, the movable operating frame 33' further comprises two resilient elements 34' disposed in the slider slots 3311' respectively for applying an urging pressure against the slider arms 332' so as to normally retain the watch display holder at the opened position.

Each of the resilient element 34', according to the preferable embodiment of the present invention, is a compression spring which is disposed in the respective slider slot 3311' and is provided between the bottom end of the slider slot 3311' and a bottom end of the slider arm 332'. Each of the resilient element 34' has two ends biasing against the bottom end of the respective slider slot 3311' and the bottom end of the respective slider arm 332' in such a manner that the resilient elements 34' will normally urge and retain the upper holder 10' in an upper position that the slider arms 332' are slid upwardly from the slider slots 3311' respectively so as to retain the distance between the upper and lower holders 10', 20'.

Since the resilient elements 34' retain the upper holder 10' in the upper position, the user is able to push the upper holder 10' towards the lower holder 20' to compress the resilient elements 34' by the slider arms 332' respectively, so as to reduce the distance between the upper and lower holders 10', 20'. Then, after placing the watch display holder within the inner circumference of the watch, the user is able to release the compression force applied on the upper and lower holders 10', 20' such that the compressed resilient elements 34' will rebound to their original forms so as to push the slider arms 332' back to their original positions. Therefore, the upper and lower supporting surfaces 11', 21' of the upper and lower holders 10', 20' are biased against the inner circumference of the watch by means of the resilient arrangement.

Moreover, by adjusting the width each of the upper and lower holders 10', 20' the upper and lower supporting surfaces 11', 21' of the upper and lower holders 10', 20' are fittedly support the inner circumference of the watch while the upper and lower holders 10', 20' are rigidly supported by the upper and lower holding frame 12', 22'.

It is worth mentioning that all kinds of watch including the belt-type and the metal link-type watches can be mounted around the watch display holder in the circular manner. Moreover, the present invention allows a watch manufacturer to use a standardized and universal watch display holder for any size of watch so as to highly reduce the manufacturing cost of the watch holder and increase the convenience and utility of the watch display holder.

What is claimed is:

1. A free size automatic watch display holder, comprising:

an upper holder providing an arc shaped upper supporting surface;

a lower holder providing an arc shaped lower supporting surface; and an extendable supporting frame comprising:

an upper support member transversely extended from an inner surface of said upper holder;

a lower support member transversely extended from an inner surface of said lower holder;

a movable operating frame comprising a base, having a slider slot, upwardly extended from said lower support member and a slider arm which is downwardly extended from said upper support member and arranged to slidably insert into said slider slot such that by frictionally sliding said slider arm along said slider slot so as to selectively adjust a distance between said upper and lower holders; and an upper holding frame extended from said inner surface of said upper holder at two end portions thereof to retain said upper holder in an arc shaped structure and a lower holding frame extended from said inner surface of said lower holder at two end portions thereof to retain said lower holder in an arc shaped structure.

2. A free size automatic watch display holder, as recited in claim 1, wherein said upper support member is mounted to said upper holder at a position above said upper holding frame and said lower support member is mounted to said lower holder at a position below said lower holding frame.

3. A free size automatic watch display holder, comprising:

an upper holder providing an arc shaped upper supporting surface;

a lower holder providing an arc shaped lower supporting surface; and an extendable supporting frame comprising:

an upper support member transversely extended from an inner surface of said upper holder;

a lower support member transversely extended from an inner surface of said lower holder;

a movable operating frame comprising a base, having a slider slot, upwardly extended from said lower support member and a slider arm which is downwardly extended from said upper support member and arranged to slidably insert into said slider slot such that by frictionally sliding said slider arm along said slider slot so as to selectively adjust a distance between said upper and lower holders, wherein said movable operating frame further comprises a resilient element which is disposed in said slider slot for applying an urging pressure against said slider arm so as to normally retain said upper holder at an upper position that said upper holder is spaced apart from said lower holder at a predetermined distance; and an upper holding frame extended from said inner surface of said upper holder at two end portions thereof to retain said upper holder in an arc shaped structure and a lower holding frame extended from said inner surface of said lower holder at two end portions thereof to retain said lower holder in an arc shaped structure.

4. A free size automatic watch display holder, as recited in claim 3, wherein said upper support member is mounted to said upper holder at a position above said upper holding frame and said lower support member is mounted to said lower holder at a position below said lower holding frame.

5. A free size automatic watch display holder, as recited in claim 3, wherein said slider arm has a predetermined length adapted to slide along said slider slot between an opened position and a closed position, wherein in said opened position, said upper holder is spaced apart from said lower holder, and in said closed position, said upper holder is moved towards to said lower holder to form a loop structure while two ends of said upper holder are biased against two ends of said lower holder respectively.

6. A free size automatic watch display holder, as recited in claim 4, wherein said slider arm has a predetermined length adapted to slide along said slider slot between an opened position and a closed position, wherein in said opened position, said upper holder is spaced apart from said lower holder, and in said closed position, said upper holder is moved towards to said lower holder to form a loop structure while two ends of said upper holder are biased against two ends of said lower holder respectively.

7. A free size automatic watch display holder, as recited in claim 3, wherein said slider arm, having a non-circular cross sectional, is slidably inserted into said slider slot having a corresponding shape and size, so as to prevent a twisting movement of said upper holder with respect to said lower holder.

8. A free size automatic watch display holder, as recited in claim 4, wherein said slider arm, having a non-circular cross sectional, is slidably inserted into said slider slot having a corresponding shape and size, so as to prevent a twisting movement of said upper holder with respect to said lower holder.

9. A free size automatic watch display holder, as recited in claim 6, wherein said slider arm, having a non-circular cross sectional, is slidably inserted into said slider slot having a corresponding shape and size, so as to prevent a twisting movement of said upper holder with respect to said lower holder.

10. A free size automatic watch display holder, as recited in claim 4, wherein said resilient element is a compression spring which is disposed in said slider slot and is provided between a bottom end of said slider slot and a bottom end of said slider arm, wherein said resilient element has two ends biasing against said bottom end of said slider slot and said bottom end of said slider arm in such a manner that said resilient element normally urges and retains said upper holder in an upper position that said slider arm is slid upwardly from said slider slot so as to retain said distance between said upper and lower holders.

11. A free size automatic watch display holder, as recited in claim 6, wherein said resilient element is a compression spring which is disposed in said slider slot and is provided between a bottom end of said slider slot and a bottom end of said slider arm, wherein said resilient element has two ends biasing against said bottom end of said slider slot and said bottom end of said slider arm in such a manner that said resilient element normally urges and retains said upper holder in an upper position that said slider arm is slid upwardly from said slider slot so as to retain said distance between said upper and lower holders.

12. A free size automatic watch display holder, as recited in claim 9, wherein said resilient element is a compression spring which is disposed in said slider slot and is provided between a bottom end of said slider slot and a bottom end of said slider arm, wherein said resilient element has two ends biasing against said bottom end of said slider slot and said bottom end of said slider arm in such a manner that said resilient element normally urges and retains said upper holder in an upper position that said slider arm is slid upwardly from said slider slot so as to retain said distance between said upper and lower holders.

13. A free size automatic watch display holder, as recited in claim 4, wherein said upper holding frame is integrally extended from said two end portions of said upper holder and said lower holding frame is integrally extended from said two end portions of said lower holder, wherein said upper and lower holding frame are made of semi-rigid material such that each of the upper and lower holding frames is capable of bending to adjust a width between two ends of each said upper and lower holders so as to retain a shape of each of said upper and lower holders.

14. A free size automatic watch display holder, as recited in claim 6, wherein said upper holding frame is integrally extended from said two end portions of said upper holder and said lower holding frame is integrally extended from said two end portions of said lower holder, wherein said upper and lower holding frame are made of semi-rigid material such that each of the upper and lower holding frames is capable of bending to adjust a width between two ends of each said upper and lower holders so as to retain a shape of each of said upper and lower holders.

15. A free size automatic watch display holder, as recited in claim 9, wherein said upper holding frame is integrally extended from said two end portions of said upper holder and said lower holding frame is integrally extended from said two end portions of said lower holder, wherein said upper and lower holding frame are made of semi-rigid material such that each of the upper and lower holding frames is capable of bending to adjust a width between two ends of each said upper and lower holders so as to retain a shape of each of said upper and lower holders.

16. A free size automatic watch display holder, comprising:

an upper holder providing an arc shaped upper supporting surface;

a lower holder providing an arc shaped lower supporting surface; and an extendable supporting frame comprising:

an upper support member transversely extended from an inner surface of said upper holder;

a lower support member transversely extended from an inner surface of said lower holder; and a movable operating frame comprising a base, having a slider slot, upwardly extended from said lower support member and a slider arm which is downwardly extended from said upper support member and arranged to slidably insert into said slider slot such that by frictionally sliding said slider arm along said slider slot so as to selectively adjust a distance between said upper and lower holders, wherein said slider arm has a predetermined length adapted to slide along said slider slot between an opened position and a closed position, wherein in said opened position, said upper holder is spaced apart from said lower holder, and in said closed position, said upper holder is moved towards to said lower holder to form a loop structure while two ends of said upper holder are biased against two ends of said lower holder respectively.

17. A free size automatic watch display holder, comprising:

an upper holder providing an arc shaped upper supporting surface;

a lower holder providing an arc shaped lower supporting surface; and an extendable supporting frame comprising:

an upper support member transversely extended from an inner surface of said upper holder;

a lower support member transversely extended from an inner surface of said lower holder; and a movable operating frame comprising a base, having a slider slot, upwardly extended from said lower support member and a slider arm which is downwardly extended from said upper support member and arranged to slidably insert into said slider slot such that by frictionally sliding said slider arm along said slider slot so as to selectively adjust a distance between said upper and lower holders, wherein said movable operating frame further comprises a resilient element which is disposed in said slider slot for applying an urging pressure against said slider arm so as to normally retain said upper holder at an upper position that said upper holder is spaced apart from said lower holder at a predetermined distance, wherein said slider arm has a predetermined length adapted to slide along said slider slot between an opened position and a closed position, wherein in said opened position, said upper holder is spaced apart from said lower holder, and in said closed position, said upper holder is moved towards to said lower holder to form a loop structure while two ends of said upper holder are biased against two ends of said lower holder respectively.

* * * * *